US007436280B2

(12) United States Patent
Jedlitschka

(10) Patent No.: US 7,436,280 B2
(45) Date of Patent: Oct. 14, 2008

(54) HIGH-VOLTAGE TRANSFORMER WINDING AND METHOD OF MAKING

(75) Inventor: Hans Jedlitschka, Chatillon (FR)

(73) Assignee: General Electric Company, Schnectady, NY (US)

( * ) Notice: Subject to any disclaimer, the term of this patent is extended or adjusted under 35 U.S.C. 154(b) by 93 days.

(21) Appl. No.: 09/964,071

(22) Filed: Sep. 25, 2001

(65) Prior Publication Data

US 2002/0036561 A1 Mar. 28, 2002

(30) Foreign Application Priority Data

Sep. 26, 2000 (FR) ..... 00 12222

(51) Int. Cl.
*H01F 5/00* (2006.01)

(52) U.S. Cl. ..... 336/200; 336/232

(58) Field of Classification Search ..... 336/65, 336/55, 57, 58, 83, 200, 206, 6, 208, 223, 336/232

See application file for complete search history.

(56) References Cited

U.S. PATENT DOCUMENTS

| | | | | |
|---|---|---|---|---|
| 2,982,889 A | | 5/1961 | Whearley et al. | 317/158 |
| 4,641,118 A | * | 2/1987 | Hirose et al. | 336/200 |
| 5,847,947 A | * | 12/1998 | Pan et al. | 336/200 |

FOREIGN PATENT DOCUMENTS

| | | | |
|---|---|---|---|
| FR | 2784261 | | 4/2000 |
| JP | 56-98805 | * | 8/1981 |

OTHER PUBLICATIONS

Pat. Abs. of Japan, vol. 014, No. 502-JP 02208909, Aug. 20, 1990.
Pat. Abs of Japan, vol. 012, No. 193,-JP 62-295404 Dec. 22, 1987.
Pat Abs. of Japan, vol. 013, No. 410, JP 01-150305 Jun. 13, 1989.

* cited by examiner

*Primary Examiner*—Tuyen T. Nguyen
(74) *Attorney, Agent, or Firm*—GE Global Patent Operation

(57) ABSTRACT

An electric winding is formed by the juxtaposition of several disks, each disk being made of an electric insulating material of good thermal conductivity and presenting a spiral-shaped groove in which an electric conductor is accommodated. The winding is applicable to high-voltage transformers used in a radiology apparatus.

13 Claims, 3 Drawing Sheets

HIGH-VOLTAGE TRANSFORMER WINDING AND METHOD OF MAKING

CROSS REFERENCE TO RELATED APPLICATIONS

This application claims the benefit of a priority under 35 USC 119 to French Patent Application No. 0012222 filed Sep. 26, 2000, the entire contents of which are incorporated by reference.

BACKGROUND OF THE INVENTION

The invention concerns high-voltage and very high-voltage transformers, notably, those used to supply voltage to X-ray tubes and, in particular, a winding for such a high-voltage and very high-voltage transformer.

An X-ray tube comprises, in a vacuum chamber, a cathode that emits a beam of electrons to an anode (or target) comprising a rotating disk coated with a material such as manganese. An electric field is created between the cathode and the anode by applying between those two elements a voltage on the order of one hundred kilovolts or more in order to accelerate the electrons emitted by the cathode. The point of impact of the accelerated beam of electrons on the rotating disk causes the anode to emit X-rays.

In order to obtain the high and very high voltages of one hundred kilovolts or more from an input voltage, it is desirable to have rectifier circuits connected to transformer windings. The transformer windings are subject to very high voltages, so that it is desirable to insulate winding turns from one another with a sufficient thickness of material which should be a good electric insulator in order to prevent electric failure, while having good thermal conductivity to carry off or dissipate heat. For that purpose, one ordinarily uses paper placed between the layers of turns and dielectric oil that fills the whole chamber in which the transformer is immersed. However, this technique does not make it possible to effectively carry off or dissipate the heat due to heating of the windings, that may be caused by an electric current. Furthermore, in some applications it is required that radiological examination be made, notably, in the case of scanners, more and more rapidly, for example, four times faster then previously, in order to reduce operating cost, which results in dissipating more heat per unit time.

In the present state of the art, one solution to that problem is to increase the volume and weight of the transformer.

BRIEF DESCRIPTION OF THE INVENTION

An embodiment of the present invention is directed to a high-voltage transformer winding which enables the heat generated by the winding to be carried off or dissipated better without an increase of volume and weight in relation to the windings.

An embodiment of the invention is directed an electric transformer winding comprising: (a) at least one plate of electric insulating material with a hole bored in the middle, and (2) a spiral-wound electric conductor placed on at least one side of the plate.

An embodiment of the invention is directed to a method of coiling for making an electric winding comprising several plates which present a spiral groove in which the electric conductor is accommodated.

BRIEF DESCRIPTION OF THE DRAWINGS

Other characteristics and advantages of the present invention will appear on reading the following description of a particular embodiment, the description being made in relation to the attached drawings in which.

DETAILED DESCRIPTION OF THE INVENTION

In an embodiment of the invention the electric insulating material has a high thermal conductivity in order to carry off or dissipate the heat originating from the electric energy dissipated in the electrical conductors.

An embodiment of the invention comprises a plurality of juxtaposed plates, each plate bearing a spiral-wound electric conductor, and the spirals of the electric conductor present an identical gyration, but are wound from outside in on one plate and from inside out on the adjacent plate. The spiral winding of the electric conductor is preferably obtained by a spiral-shaped groove or channel that is traced on at least one side of the plate in order to accommodate the electric conductor. To enable the electric conductor to pass from one plate to the adjacent plate, a first plate presents a notch at the outer point of the spiral, while the adjacent plate (or second plate) presents a notch at the inner point of the spiral, so that the electric conductor passes from the first plate to the adjacent (or second plate) through the outer notch of the first plate and from that adjacent plate to the next plate (or third plate) through the inner notch of the second plate, the third plate presenting an outer notch like the first plate.

The electric conductor is preferably of single-strand or multiple-strand type circular section.

The shape of the bottom of the groove is preferably adapted to that of the electric conductor cross-section, but it can be semicircular or flat. The periphery of the plate can have any shape, but pointed shapes should be avoided.

The shape of the contour of the center bore of the plate is adapted to the outer shape of the support on which it is mounted. The plates have means, such as lugs cooperating with blind holes, to permit and facilitate assembly of the plates.

Assembly of the plates is arranged to provide spaces between the plates, spaces intended to be filled with an electric insulator of high thermal conductivity.

The electric insulator of high thermal conductivity placed between the plate can be liquid or solid at temperature of use.

Figure 1:
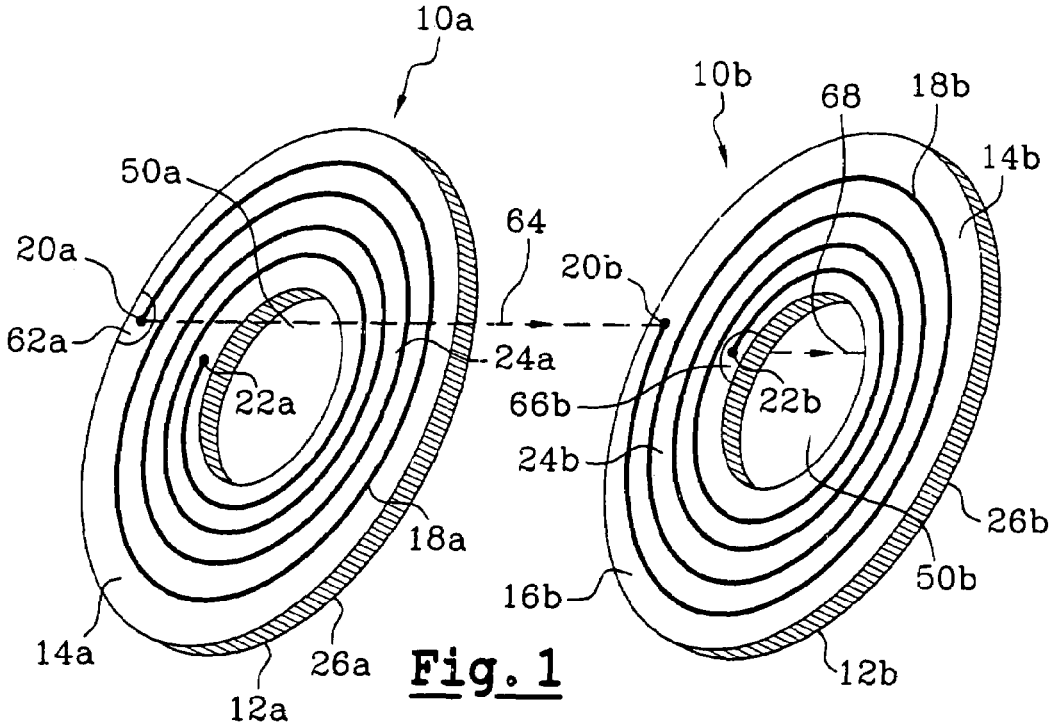
FIG. 1 is a schematic view of two adjacent disks with an electric conductor.
Figure 2:
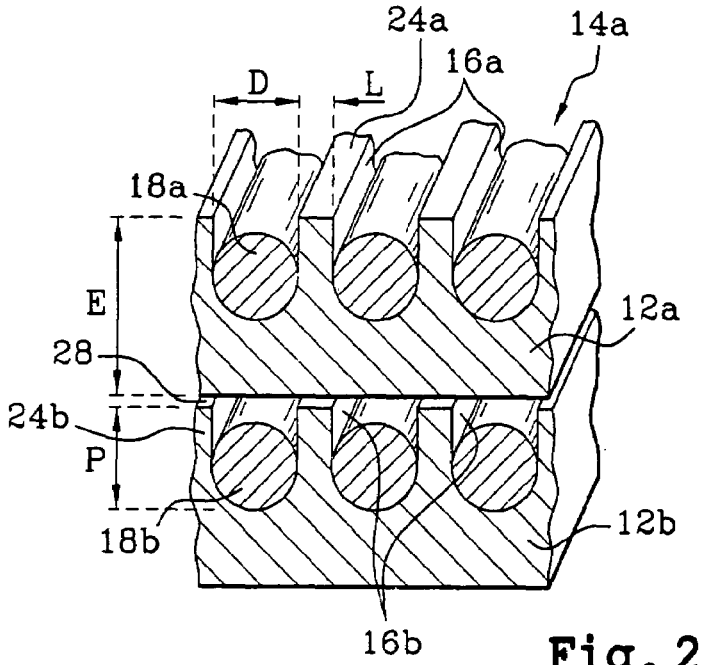
FIG. 2 is a view in enlarged section and in perspective of a part of two adjacent disks with an electric conductor.
Figure 3:
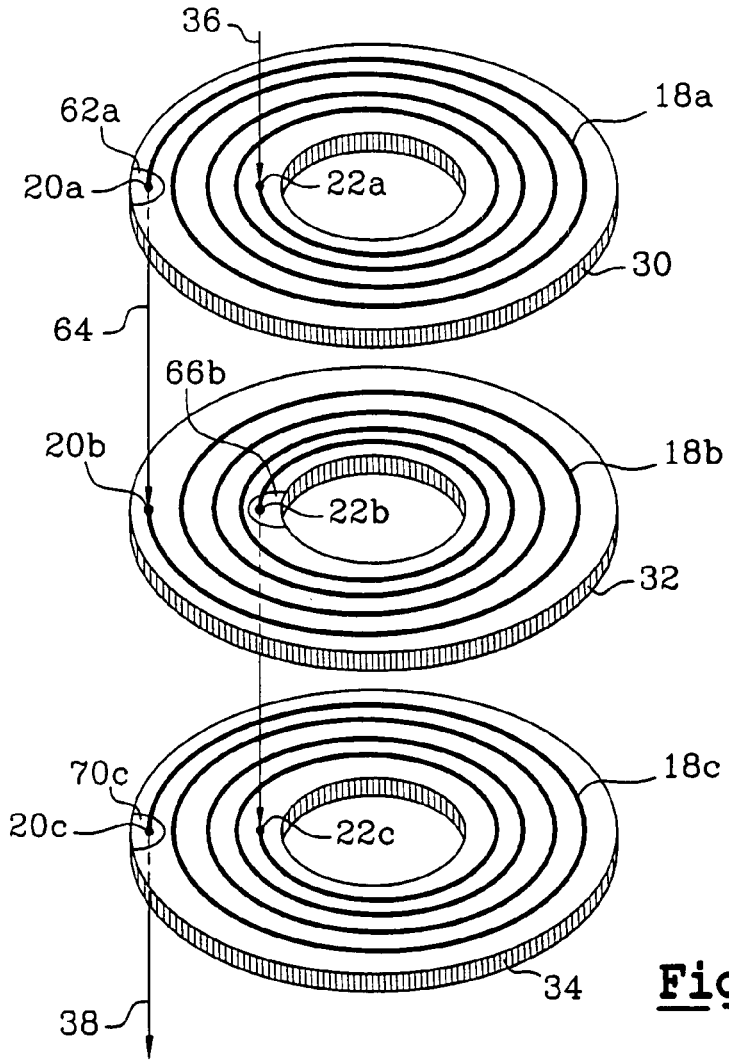
FIG. 3 is a schematic view showing the assembly of three juxtaposed disks with an electric conductor.
Figure 4:
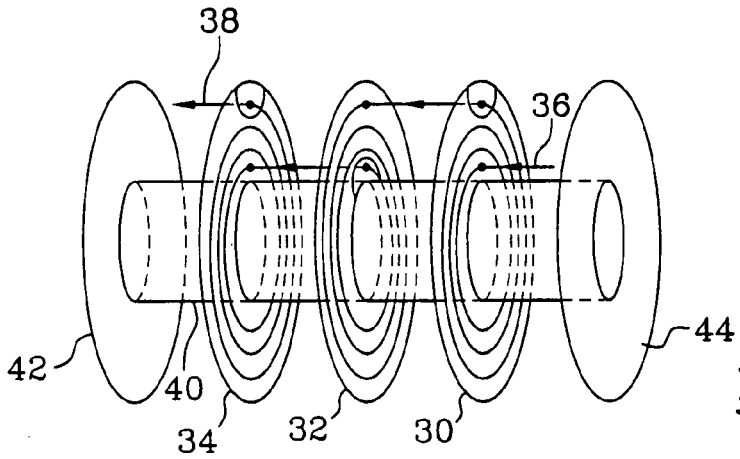
FIG. 4 is a schematic view of a mounting of three disks on a mandrel.
Figure 5:
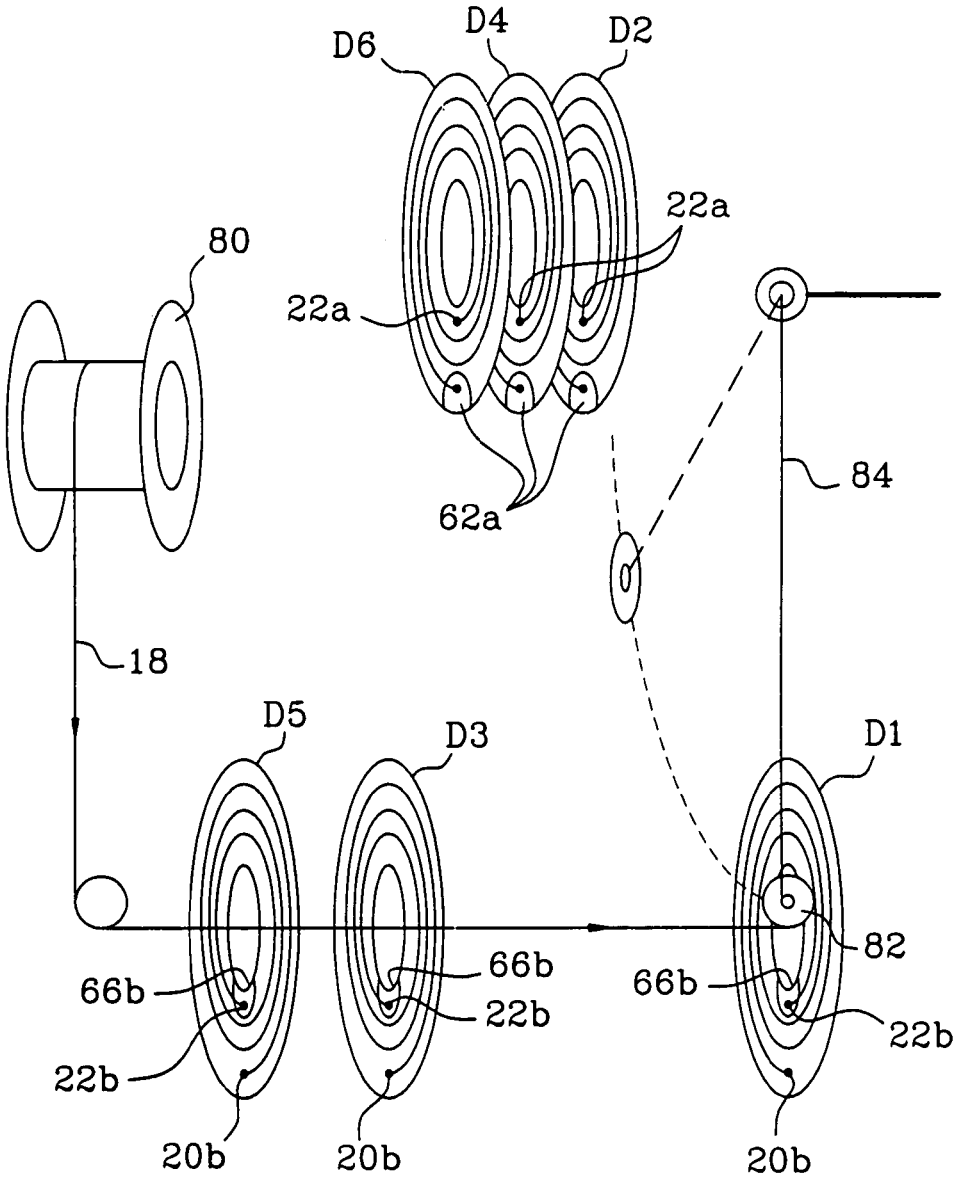
FIG. 5 is a diagram illustrating a method for placing the electric conductor in spirals of the disks of the winding.

It is to be noted that the views of FIGS. 1, 3, 4 and 5 are very schematic and do not represent the relative dimensions represented in the view of FIG. 2.

A winding 10*a*, 10*b* comprises (FIGS. 1 and 2) a circular disk or plate 12*a* or 12*b* of insulating material, one side 14*a* or 14*b* of which presents a spiral groove or channel 16*a* or 16*b*, the other side 26*a* or 26*b* being flat. An electric conductor 18*a* or 18*a* is accommodated in the groove 16*a* or 16*b* and emerges from the groove at a first peripheral end 20*a* or 20*b* and at a second central end 22*a* or 22*b*.

The adjacent channels of the spiral are separated by a wall 24*a* or 24*b*, also spiral-shaped. The electric conductor is held in the spiral groove by any means such as by glue points.

The disk 12*a* or 12*b* is bored in the middle with a hole 50*a* or 50*b*. The disk 12*a* presents on its periphery an outer end point 20*a* of the spiral, a notch 62*a* for passage of the electric conductor 18*a* in the direction (dotted line 64) of the spiral outer starting point 20*b* of the disk 12*b*. On the other hand, disk 12*b* does not present any notch on its periphery at point 20*b*, but a notch 66*b* at the inner end point 22*b* of the spiral for passage of the electric conductor 18*b* in the direction (dotted line 68) of the inner starting point of the spiral of the following adjacent disk.

It is to be noted that the spiral-shaped grooves 16*a* and 16*b* have the same gyration, for example, counterclockwise, in order to go from the inner point 22*a* to the outer point 20*a* of disk 12*a*, and then from the outer point 20*b* to the inner point 22*b* of disk 12*b*. The winding of the turns of the spiral is therefore made from inside 22*a* out 20*a* for disk 12*a* and from outside 20*b* in 22*b* for disk 12*b*.

As a result of these characteristics of the spirals and of passage of the electric conductor from one disk to the adjacent disk either on the periphery of the disk or through the inner bore, the magnetic fields created by an electric current crossing the electric conductors 18*a* and 18*b* are added together.

By way of indication, the disk 12 has a thickness E of one millimeter, the groove has a depth P of 6/10 millimeter and the wall 24 has a width L of 2/10 millimeter. The groove 16 makes it possible to accommodate an electric conductor 18 with circular section having a diameter D of 6/10 millimeter.

The bottom of the groove can be of any shape, semicircular or flat, to accommodate a cylindrical electric conductor with circular section, as represented in FIG. 2. The electric conductor comes preferably with circular section, but can be of any other shape, on condition that it does not present sharp edges favoring the appearance of electric discharges.

The insulating material of the disk can be of all known types creating good electric insulation and presenting high thermal conductivity. It is preferably of a material described in published French patent application No. 2,784,261 filed on Oct. 5, 1998.

The disk can have different shapes, for example, the circular shape shown in the figures, but other shapes are possible, such as the oval shape or rectangular shape with rounded corners. The same is true of the spiral which can wed the shape of the disk or have a shape other than that of the disk. The interior bore can also be of any shape and wed the outer shape of the disk or not. The shape of the interior bore will correspond to that of the magnetic hub on which the winding will be mounted.

In general, the support of the spiral electric conductor is a plate of electric insulating material in order to secure good electric insulation between the turns and with good thermal conductivity to allow effective dissipation of the heat generated by the losses in the electric conductor. The adjacent grooves of a spiral are separated by a wall 24*a* and 24*b*, which makes the electric insulation between two adjacent turns of the electric conductor.

An embodiment of the invention could be applied by using an insulated electric conductor which would be spiral-wound flat on an insulating plate, the electric insulation being obtained by the conductor itself insulated and possibly reinforced by injection of an insulating product between the turns.

In an embodiment of the invention, several windings 10 are grouped to form a coil by juxtaposing several disks 12, so that the side 14*b* presenting the groove 16*b* of disk 12*b* is opposite the flat side 26*a* of disk 12*a* and is covered by the latter, while possibly leaving a space 28 between the two disks.

That space 28 is provided to receive a material having good thermal conductivity, so as to carry off the heat emanating from the electric energy dissipated in the conductor 18. That material is, for example, in the form of a fluid such as a dielectric oil, but can be in the form of a solid such as a silicone or a polymer.

To create a coil, the electric conductor 18 of a disk 30 (FIGS. 3 and 4) passes over the following disk 32 at point 20*b* through the outer notch 62*a* of disk 32. The conductor 18 then passes to the third disk 34 at point 22*c* through the spiral of disk 32 and the inner notch 66*b* at point 22*b*. Finally, the conductor 18 comes out of the third disk 34 at point 20*c* through a notch 70*c* in order to pass (arrow 38) to the fourth disk not represented. On the first disk 30, the conductor 18 from the previous disk arrives (arrow 36) at point 22*a*.

The spirals of disks 30, 32 and 34 have the same gyration, for example, counter-clockwise, as in FIG. 1, but are wound from inside out for disks 30 and 34 and from outside in for the central disk 32. Furthermore, passage of the conductor 18 from one disk to the next is carried out on the outside between disk 30 and disk 32, or on the inside between disk 32 and disk 34. As a result, the electric current circulating in the electric conductor 18 creates a magnetic field in each disk, which is added to the other magnetic fields created in the other disks.

The group of disks of a coil can be formed on a mandrel 40, which cooperates with the bores 50 of the disks. The disks are maintained against one another by two flanges 42 and 44, which are kept pressed against the disks by threaded rods and nuts, for example (not represented). The spaces 28 between the disks are obtained, for example, by wedges not represented and the angular position of the disks is maintained, for example, by lugs cooperating with blind holes (both not represented) and placed on the sides of each disk.

The spaces 28 between the disks can be filled with an electric insulating product having, furthermore, very good electric conductivity for carrying off heat. That product can be in solid form. When the conditions of use are harsh, the coil can be placed in a closed container which is filled with an electric insulating fluid having a very good thermal conductivity. The fluid is possibly cooled by refrigeration means such as a radiator.

The coils according to the invention present the following advantages: (1) they can support very high electric voltages by the use of insulating disks and grooves for accommodating the electric conductors; (2) they can be encapsulated in a material in solid form at working temperature, but can also be immersed in a cooling oil; (3) the electric conductors can be varnished or can be of multiple-strand type; (4) the electric insulating material of the disk has better electric conductivity than the insulation paper used in the coils of the prior art; it also has a better dielectric constant and lower dielectric losses; (5) the cost of the disks is inexpensive, for they are made by molding; and (6) the disks contribute to easy assembly to obtain a coil.

An embodiment of the invention also concerns a method of winding for making a coil by means of disks. The method comprises (FIG. 5) calculating the number N of disks which are desirable for making the coil, for example, N=6. Among those six disks, three, D1, D3 and D5, will have a spiral along disk 12*b* with an inner notch 66*b* and three, D2, D4, D6, will have a spiral along disk 12*a* with an outer notch 62*a*.

The electric conductor 18, coming from a wire coil 80, passes inside the bores of disks D5 and D3 and its end leads to the disk D1 at the inner point 22*b* in notch 66*b*. Disk D1 is borne by a mandrel (not represented) carried by an articulated arm 84. By turning disk D1 in the right direction, the conductor 18 is accommodated by means of a roller 82 in the spiral groove in order to end at the outer point 20*b*. The arm 84 is then moved to take disk D2 and bring it to the mandrel in a position adjacent to disk D1. In that adjacent position, the conductor 18 is accommodated in the outer notch 62*a* of disk D2 in order to pass from the other side of the disk. By rotation of the mandrel in the right direction, the conductor 18 is accommodated by means of the roller 82 in the spiral of disk D2 in order to end at the inner point 22*a*.

Disk D3 is then brought against disk D2 and the conductor 18 is passed into the inner notch 66*b* in order to cross the thickness of disk D3. By rotation of the mandrel in the right direction, the electric conductor 18 is accommodated by means of the roller 82 in the spiral of disk D3 in order to end at the outer point 20*b*.

Disk D4 is then brought to the mandrel in the same way as disk D2 in order to be juxtaposed with disk D3 and create the spiral winding. It is then the turn of disk D5, followed by disk D6. After disk D6, coil winding is completed and comprises six juxtaposed disks D1 to D6.

The above description reveals that the winding method has the following stages, comprising the following steps:

(a) fabricating the first plurality of plates D1, D3, D5 comprising, on one side, a spiral groove 16*b* and a central bore 50*b*, the spiral groove extending from the central bore to the periphery of the plate;

(b) fabricating a second plurality of plates D2, D4, D6, each comprising, on one side, a spiral groove 16*a* and a central bore 50*a*, the spiral groove extending from the periphery of the plate to the central bore;

(c) passing an electric conductor 18 inside the bores of the plates of the first plurality D1, D3, D6;

(d) fastening a plate D1 of the first plurality of plates on a mandrel;

(e) turning the mandrel in order to set the electric conductor 18 in place in the groove, starting from the central bore;

(f) stopping the rotation of the mandrel, when the electric conductor 18 comes to the outer end of the spiral;

(g) fastening a plate D2 of the second plurality of plates on the mandrel;

(h) turning the mandrel in order to set the electric conductor 18 in place in the groove, starting from the outer end of the spiral;

(i) stopping the rotation of the mandrel when the electric conductor 18 ends at the central bore; and (j) repeating steps d to i until obtaining the winding on the plates of both pluralities of plates.

Various modifications in structure and/or steps and/or function may be made by one skilled in the art without departing from the scope and extent of the invention as recited in the claims.

What is claimed is:

1. An electric transformer winding for voltage on the order of 100 Kv or more comprising:

a plurality of juxtaposed plates, each plate having a spiral-wound electric conductor and made of a material having a high thermal conductivity;

the spirals of the conductor being substantially the same;

the conductors being wound from outside in on one plate and from inside out on an adjacent juxtaposed plate;

each of the plurality of plates having a spiral-shaped groove in which conductor is accommodated;

each of the spiral-shaped grooves being substantially the same;

a wall separating adjacent spiral grooves on each plate, the wall forming a space between adjacent plates for receiving in the space a product having a high thermal conductivity; and means for assembling juxtaposed plates to one another.

2. The electric winding according to claim 1 comprising:

each plate having a hole bored in the middle.

3. The electric winding according to claim 1 wherein one plate presents a notch at the outer point of the spiral, while the adjacent plate presents a notch at the inner point of the spiral, so as to make the conductor pass from one plate to the adjacent plate on the coil winding operation.

4. The electric winding according to claim 1 wherein the electric conductor is of circular cross-section.

5. The electric winding according to claim 1 wherein the bottom of the groove has the shape of a semicircle.

6. The electric winding according to claim 1 wherein the plate has the shape of a disk, the periphery of which is circular.

7. The electric winding according to claim 1 wherein the plate has the shape of a disk, the periphery of which is oval.

8. The electric winding according to claim 1 wherein the bore of the plate has a contour adapted to that of the support on which it is mounted.

9. The electric winding according to claim 1 wherein the electric insulator of high thermal conductivity which fills the space is in solid form at the temperature of use.

10. The electric winding of claim 1 wherein adjacent spiral-shaped grooves are separated by an insulator.

11. The electric winding of claim 1 wherein the electric conductor is an insulated conductor.

12. The electric winding of claim 1 wherein the electric conductor is provided with insulation between the turns.

13. The electric winding of claim 1 wherein an electric current formed in the conductors create a magnetic field in each plate, the magnetic fields being additive.

* * * * *